US006494769B1

(12) United States Patent
Sinclair et al.

(10) Patent No.: US 6,494,769 B1
(45) **Date of Patent: *Dec. 17, 2002**

(54) WAFER CARRIER FOR CHEMICAL MECHANICAL PLANARIZATION POLISHING

(75) Inventors: James Sinclair, San Jose, CA (US); Lawrence L. Lee, Mountain View, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/586,733

(22) Filed: Jun. 5, 2000

Related U.S. Application Data

(63) Continuation of application No. 08/900,184, filed on Jul. 25, 1997.

(51) Int. Cl.[7] ..... B24B 29/00
(52) U.S. Cl. ..... 451/288; 451/289
(58) Field of Search ..... 451/6, 286, 287, 451/288, 289, 290, 388, 398

(56) References Cited

U.S. PATENT DOCUMENTS

| | | | |
|---|---|---|---|
| 4,272,924 | A | 6/1981 | Masuko et al. |
| 4,313,284 | A | 2/1982 | Walsh |
| 4,425,038 | A | 1/1984 | La Fiandra et al. |
| 4,508,161 | A | 4/1985 | Holden |
| 5,036,630 | A | 8/1991 | Kaanta et al. |
| 5,205,082 | A | 4/1993 | Shendon et al. |
| 5,230,184 | A | 7/1993 | Bukhman |
| 5,335,453 | A | 8/1994 | Baldy et al. |
| 5,362,969 | A | 11/1994 | Glenn |
| 5,398,459 | A | 3/1995 | Okumura et al. |
| 5,423,558 | A | 6/1995 | Koeth et al. |
| 5,423,716 | A | 6/1995 | Strasbaugh |
| 5,527,209 | A | 6/1996 | Volodarsky et al. |
| 5,582,534 | A | 12/1996 | Shendon et al. |
| 5,584,751 | A | 12/1996 | Kobayashi et al. |
| 5,588,902 | A | 12/1996 | Tominaga et al. |
| 5,624,299 | A | 4/1997 | Shendon |
| 5,635,083 | A | 6/1997 | Breivogel et al. |
| 5,643,053 | A | 7/1997 | Shendon |

(List continued on next page.)

FOREIGN PATENT DOCUMENTS

| | | | |
|---|---|---|---|
| EP | 0 774 323 A2 | 5/1997 | ..... B24B/37/04 |

*Primary Examiner*—George Nguyen
*Assistant Examiner*—Dung Van Nguyen
(74) *Attorney, Agent, or Firm*—Moser, Patterson & Sheridan

(57) ABSTRACT

An apparatus, and particularly, a wafer carrier for polishing the face of a semiconductor wafer are provided. The wafer carrier forms a first cavity which can be pressure controlled to vary the shape of a face of a platen which contacts the wafer during polishing. A second cavity within the first cavity is provided. The second cavity can be independently pressure controlled to form a vacuum for holding the wafer against the platen surface or for forming a pressure stream to separate the wafer from the platen and/or to purge the holes in the surface of the platen. A non-contact displacement sensor capable of measuring a distance between the wafer carrier mount and the platen, may be provided. An endpoint detector capable of detecting a relative surface roughness of the wafer, to determine when the wafer has been sufficiently polished, may also be provided. A ring is peripherally located about an outer edge of the platen, and is mounted and positioned to resist lateral forces on the wafer during polishing. The ring is adjustably mounted so as to be variably and controllably vertically positioned, with respect to the wafer to help control standing waves in the polishing media and uneven polishing of the wafer surface.

19 Claims, 6 Drawing Sheets

U.S. PATENT DOCUMENTS 5,643,061 A 7/1997 Jackson et al.
5,672,091 A * 9/1997 Takahashi et al. ..... 451/6
5,681,215 A 10/1997 Sherwood et al.
5,733,182 A 3/1998 Muramatsu et al.
5,762,539 A 6/1998 Nakashiba et al.
5,777,739 A 7/1998 Sandhu et al.
5,791,978 A 8/1998 Cesna et al.
5,803,799 A 9/1998 Volodarsky et al.
5,820,448 A 10/1998 Shamouilian et al.
5,838,447 A 11/1998 Hiyama et al.
5,851,136 A 12/1998 Lee
5,908,530 A * 6/1999 Hoshizaki et al. ..... 156/345
6,113,479 A * 9/2000 Sinclair et al. ..... 451/288

* cited by examiner

WAFER CARRIER FOR CHEMICAL MECHANICAL PLANARIZATION POLISHING

This is a continuation of application Ser. No. 08/900,184, filed Jul. 25, 1997.

CROSS-REFERENCE TO RELATED APPLICATIONS

This application is related to a co-pending application filed concurrently herewith, entitled "Low Profile, Low Hysteresis Force Feedback Gimbal System For Chemical Mechanical Polishing" which is hereby incorporated by reference herein in its entirety.

1. Technical Field

The present invention relates to the polishing of semiconductor wafers of the type from which chips for integrated circuits and the like are made. More specifically in a chemical mechanical polishing or planarization (CMP) process a semiconductor wafer is held by a wafer carrier and is polished by contact with an abrasive material in a controlled chemically active environment 2. Background Art As part of the manufacturing process of semiconductor devices, semiconductor wafers are polished by CMP. The uniform removal of material from and the planarity of patterned and un-patterned wafers is critical to wafer process yield. Generally, the wafer to be polished is mounted on a wafer carrier which holds the wafer using a combination of vacuum suction or other means to contact the rear side of the wafer and a retaining lip or ring around the edge of the wafer to keep the wafer centered on the wafer carrier. The front side of the wafer, the side to be polished, is then contacted with an abrasive material such as an abrasive pad or abrasive strip. The abrasive pad or strip may have free abrasive fluid sprayed on it, may have abrasive particles affixed to it, or may have abrasive particles sprinkled on it.

The ideal wafer polishing process can be described by Preston's equation: $R=K_p*P*V$, where R is the removal rate; Kp is a function of consumables (abrasive pad roughness and elasticity, surface chemistry and abrasion effects, and contact area); P is the applied pressure between the wafer and the abrasive pad; and V is the relative velocity between the wafer and the abrasive pad. As a result, the ideal CMP process should have constant cutting velocity over the entire wafer surface, constant pressure between the abrasive pad and wafer, and constant abrasive pad roughness, elasticity, area and abrasion effects. In addition, control over the temperature and pH is critical and the direction of the relative pad/wafer velocity should be randomly distributed over the entire wafer surface.

One common type of wafer polishing apparatus is the CMP model 372M made by Westech Systems Inc. A wafer is held by a wafer carrier of the model 372M. The wafer carrier rotates about the axis of the wafer. A large circular abrasive pad is rotated while contacting the rotating wafer and wafer carrier. The rotating wafer contacts the larger rotating abrasive pad in an area away from the center of the abrasive pad.

Another related apparatus is a polishing machine for polishing semiconductor wafers containing magnetic read-write heads, disclosed in U.S. Pat. No. 5,335,453 to Baldy et al. With this machine, a semiconductor wafer is held by a wafer carrier which is moved in a circular translatory motion by an eccentric arm. The wafer is polished by contacting an abrasive strip which is advanced in one direction. The relative motion between the wafer and the abrasive strip is a combination of the circular motion of the wafer and the linear motion of the advancing abrasive strip.

While the precessing circle polishing pattern should provide more uniform velocities such that different points on the wafer see similar velocities at any given time, the velocities are still not constant. Assuming the rotation of the eccentric arm is held to a constant angular speed, the precessing circle relative motion results in fluctuating velocities. When the wafer is rotating away from the precessing direction the net relative velocity is lower, and when the wafer is rotating with precessing direction the net relative velocity is higher.

Moreover, the apparatus has the disadvantage of not being able to provide alternative polishing patterns. Since the wafer carrier is mounted on a rotating eccentric arm, the wafer can only be polished by moving in a circle. Polishing patterns other than circular are desired for a number of reasons.

One such reason is to provide more uniform wear of the abrasive pad. Non-uniform wear of the abrasive pad results in a non-uniform removal rate of wafer material since more heavily worn sections of the abrasive pad remove material at a lower rate. Non-uniform wear also results in less efficient use of the abrasive pad itself, since the pad must be changed more often or advanced at a faster rate in order to avoid using portions of the pad which wear out first.

Many CMP wafer carriers currently available yield wafers having anomalies in planarity. Two pervasive problems that exist in most CMP wafer polishing apparatuses are under-polishing of the center of the wafer, and the inability to adjust the control of wafer edge exclusion as process variables change. For example, wafer carriers used on many available CMP machines experience a phenomenon known in the art as "nose diving". During polishing, the head reacts to the polishing forces in a manner that creates a sizable moment. This moment causes a pressure differential along the direction of motion of the head. The result of the pressure differential is the formation of a standing wave of the chemical slurry that interfaces the wafer and the abrasive surface. This causes the edge of the wafer which is at the leading edge of the wafer carrier, to become polished faster and to a greater degree than the center of the wafer.

The removal of material on the wafer is related to the chemical action of the slurry. As slurry is inducted between the wafer and the abrasive pad and reacts, the chemicals responsible for removal of the wafer material gradually become exhausted. Thus, the removal of wafer material further from the leading edge of the wafer carrier (i.e., the center of the wafer) experiences a diminished rate of chemical removal when compared with the chemical action at the leading edge of the wafer carrier (i.e., the edge of the wafer), due to the diminished activity of the chemicals in the slurry when it reaches the center of the wafer. This phenomenon is sometimes referred to as "slurry starvation".

Since the motion of the wafer is generally not linear but rotary, the wafers produced have generally been characterized by a domed or dished surface rather than the desired planar surface. Several attempts have been made to correct the domed or dished oxide removal patterns.

One such attempt was carried out by blowing air behind the wafer near its center. Theoretically, the air pressure would tend to slightly increase the pressure between the center of the wafer and the abrasives, thereby increasing the rate of abrasion at the center to match the rate of abrasion at the periphery of the wafer so as to form a planar product.

However, the results of this process have proven unsatisfactory because of an inability to consistently control the pressure of the air trapped between the center of the wafer and the wafer carrier.

In another attempt, the wafer has been bonded around its periphery to a bladder on the wafer carrier to form a pocket in the center which can be filled with air to achieve the results attempted as described in the previous attempt. A problem with this approach is that the bladder is not sufficiently stiff to resist the polishing forces, leading to either failure of the seal which holds the air pocket in, or complete failure of the polishing process.

Still other attempts have been made to shape a film or carrier of a head with a slight crown or radius. This gives a desirable effect as long as none of the variables change during polishing. A major drawback is that the curvature of the crown or radius cannot be adjusted to adapt to changing variables in the process. Thus there is a need for a wafer carrier having a surface which can be adjustably controlled and maintained against a wafer to correct for anomalies in the abrasive removal of the wafer surface.

Japanese Laid-Open Patent Application No. 8-39422 to Shendon discloses a wafer carrier for positioning a substrate with respect to a rotating polishing pad. A first chamber within the wafer carrier is provided with a bellows which is expandable for applying a first pressure onto the substrate. A second chamber is provided beneath the first chamber for applying a pressure to a lower contoured wall that interfaces with the substrate.

U.S. Pat. No. 5,205,082 to Shendon et al. discloses a CMP device which attempts to control the relationship between the platen, ring and pad by tying the platen and the ring together through a flexible diaphragm. However, by allowing the ring to float with respect to the platen, the ring can be upset by changes in abrasive pad flatness, roughness, and friction. When the ring is disturbed, the pressure on the periphery of the wafer increases. This can contribute to poor planarity because of more pronounced oxide removal rates near the wafer edges.

DISCLOSURE OF THE INVENTION

The present invention include a novel wafer carrier for polishing wafers and other articles requiring a high degree of planarization in their manufacture. The wafer carrier made in accordance with the present invention comprises a number of improved features for effecting the above-stated goals. One feature of the present invention employs a flexible crown platen, deformable under changes in pressure to induce an exact amount of bowing in the platen. The platen, deformed and reshaped under precise control, allows for precise polishing to occur as planarization variables change during polishing.

One advantage of the present invention is precision. By allowing precise control over the bowing of the crown platen, particular areas of the article being polished can be emphasized. Areas needing additional polishing will be accommodated by exerting a convex and/or concave shape to the platen to either emphasize or de-emphasize particular polishing areas.

Another advantage is increased productivity, since the shape of the platen can be readily varied without the need for removing the carrier wafer or retooling in any manner. Therefore, changes in the surface of a substrate which might occur during polishing can be readily accomodated by the present invention, without any significant "down time". Other advantages and features of the present invention will become clear in the detailed description of the invention as read in conjunction with the accompanying figures.

BEST MODE FOR CARRYING OUT THE INVENTION

Figure 1:
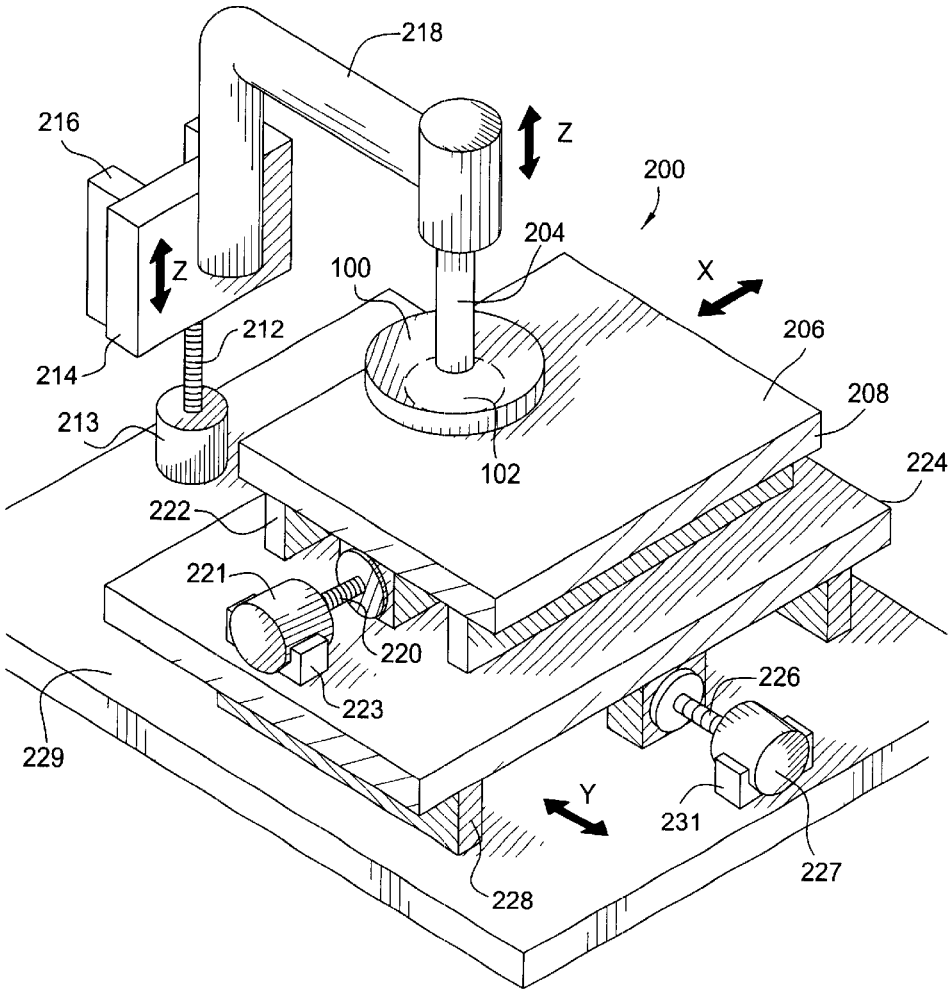
FIG. 1 is a diagrammatic perspective view of a polishing apparatus employing an improved wafer carrier according to the present invention.

The following description refers to specific embodiments by way of reference to the figures and reference numerals contained therein. The description is for purposes of satisfying disclosure requirements and is not to be limiting of the invention, which is defined by the claims below, and which includes equivalents thereof.

An example of an apparatus 200 for polishing semiconductor wafers, using a wafer carrier 100 according to the present invention, is diagramatically illustrated in FIG. 1. Although the apparatus shown in FIG. 1 is a preferred apparatus for use with the wafer carrier according to the present invention, the present invention is not intended to be limited to this type of apparatus, but can be used with other types of CMP apparatus, as will be readily apparent to those of ordinary skill in the art. For example, the wafer carrier according to the present invention could be used with an apparatus which employs a rotary motion of the wafer carrier or other nonlinear motion.

In FIG. 1, the rear side of wafer 102 is held by wafer carrier 100, while the front side of wafer 102 is contacted by abrasive pad 206. Wafer carrier 100 is connected to a post 204 which may move wafer carrier 100 and wafer 102 in the Z-direction, which is perpendicular to the plane of wafer 102, so that wafer 102 may be brought into contact with abrasive pad 206. Post 204 may also apply polishing force in the Z-direction on wafer carrier 100 and wafer 102. The Z-direction movement and force applied to wafer carrier 100 is preferably provided by a servo. The servo may include a lead screw 212, which pushes a plate 214 attached to a linear slide 216. Cross-member 218 is fastened to plate 214 and also to post 204. Preferably, in this embodiment of an apparatus, lead screw 212 is driven by an electric motor 213 mounted to base 229 and which is computer controlled so that the user may program the force applied during the polishing process. One skilled in the art will realize that other methods of providing Z-direction movement and force are practicable.

Post 204 and wafer carrier 100 hold wafer 102 in a substantially fixed position in X and Y-directions, which are parallel to the plane of wafer 102 and perpendicular to each other. Preferably, in this embodiment, wafer carrier 100 and wafer 102 do not rotate about an axis perpendicular to and passing through the center of wafer 102, i.e., about any axis substantially perpendicular to the plane in which abrasive pad 206 lies.

Table 208 is movable in both the X and Y-directions. Preferably, table 208 is movable in the X-direction by action of lead screw 220 and linear slide 222. Similarly table 208 is movable in the Y-direction by being mounted on plate 224 which is mounted to linear slide 228 and actuated by lead screw 226. Note that linear slide 228 is also mounted to base 229. Also preferably, lead screws 220 and 226 are driven by infinitely positionable electric motors 221 and 227 which are mounted to plate 224 and base 229 using brackets 223 and 231, respectively. Motors 221 and 227 are preferably computer controlled so that the user may program the table to move in an infinite number of patterns.

While lead screws are used in the presently preferred embodiment of the invention, one skilled in the art would recognize that other servo means would be practicable, for example a rack-and-pinion servo means.

FIG. 2 shows a preferred embodiment of a wafer carrier 100 according to the present invention. Wafer carrier 100 is mounted via wafer carrier mount 110 to chuck 104 which in turn is mountable to post 204 of a CMP machine. Wafer carrier mount 110 is preferably mounted to chuck 104 by bolts but other equivalent forms of mounting may be employed as would be readily apparent to those of ordinary skill in the art. Similarly, chuck 104 may be bolted, threaded or otherwise mounted to post 204. Gimbal 108 is mounted to chuck 104 (preferably by bolting) and allows wafer carrier 100 to tilt and rotate with respect to chuck 104. At least one antirotation pin 106 is provided to prevent rotation of wafer carrier 100 with regard to chuck 104. Thus, although tilting of the wafer carrier 100 with respect to chuck 104 about two axes will still be allowed by gimbal 108, the antirotation pin or pins 106 prevent any substantial rotation of wafer carrier 100 about its central axis, with respect to chuck 104. Preferably, three antirotation pins 106 are circumferentially provided at equally spaced intervals of about 120° around the center of chuck 104. However, more or fewer antirotation pins may be used.

Antirotation pin 106 is slidably mounted within a bore 107 in chuck 104, to allow vertical movements of the antirotation pin with respect to the chuck. Antirotation pin 106 may be driven in a vertical direction upon tilting of wafer carrier 100 with respect to chuck 104. O-ring 109 provides a snug fit between antirotation pin 106 and bore 107 while still allowing pin 106 the freedom of vertical movement. Antirotation pin 106 is securely fixed in wafer carrier mount 110, preferably by threading into a threaded hole 118 of wafer carrier mount 110, although other equivalent methods of secure fixation may be employed.

Wafer plate or platen 112 is mounted to wafer carrier mount 110, preferably by bolts (or other equivalent mounting devices, as described similarly to bolts 106 above). Wafer plate 112 provides the surface 112*a* which interfaces with wafer 102 for applying pressure and other manipulative forces which ultimately effect the manner and rate in which material is removed from the wafer surface. Wafer plate 112 is formed of metal, preferably steel or aluminum, and is therefore stiff enough to maintain the shape of the platen or wafer plate surface 112*a* under polishing forces.

A sealing element or elements, preferably O-ring 116, is provided at the joint between wafer carrier mount 110 and wafer plate 112 to provide an air-tight seal. Thus, an airtight cavity 118 is formed within the structure defined by joining wafer carrier mount 110 and wafer plate 112. One or more pressure fittings 120 are threadably or otherwise mounted in an airtight fashion through wafer carrier mount 110. An access opening 129 is provided in wafer carrier mount 110 for each pressure fitting 120, so that a pressure/vacuum source may be readily attached to the pressure fitting(s) 120.

Thus, gas or liquid, preferably air, can be inputted and outputted through fitting(s) 120 in order to vary the pressure in cavity 118. Wafer plate 112 acts as a diaphragm in response to changing pressures in cavity 118. A significant positive pressure in cavity 118 causes surface 112*a* to crown, i.e., become convex with respect to the surface of wafer 102. Conversely, a significant negative pressure in cavity 118 causes surface 112*a* to dish, i.e., become concave with respect to the surface of wafer 102

According to a preferred embodiment, an electronic computer controlled pressure regulator 122 (shown in phantom) is provided so that the pressure in cavity 118 is programmable and accurately controlled. By controlling the amount of fluid or gas in cavity 118, surface 112*a* can be controlled to flex into a concave or convex shape by a predetermined amount, thus advantageously changing the shape of wafer 102 during polishing.

Further, since the preferred embodiment of the wafer carrier according to the present invention is not designed to rotate (although other embodiments of the same may certainly be readily adapted to rotate), extensive onboard instrumentation may be provided to improve the precision of the polishing results. For example, a non-contact displacement sensor is provided in cavity 118 adjacent wafer plate 112 to sense the amount of deflection of surface 112*a*.

Preferably, the non-contact displacement sensor comprises a capacitive probe 124 and electronic circuitry 124*a* to interpret the readings of capacitive probe 124 and input data to a controller (not shown) which evaluates the actual amount of deflection, and, based upon the actual amount of deflection compared to a desired amount of deflection, controls an input or output of gas or liquid to or from cavity 118. This process is repeated continuously and iteratively to attain and maintain an equivalency between the actual amount of deflection and the desired amount of deflection.

An estimate of the amount of deflection of surface 112*a* may be made based upon the pressure in cavity 118, the dimensions of surface 112*a*, the thickness of the metal portion that forms the surface 112*a* and the type of metal which is used to form the metal portion that forms the surface 112*a*. However, the actual deflection will vary from platen to platen due to internal stresses present in the metal forming the platen, which may vary with each individual platen. The non-contact displacement sensor provides an accurate and precise measurement of the actual displacement of the surface 112*a* of the platen.

Although the preferred non-contact displacement sensor comprises a capacitive probe, it is noted that other available and equivalent forms of non-contact sensors could be substituted for the capacitive probe to achieve the same results. It is further noted that, although less efficient, the non-contact probe could be manually monitored (i.e., without the presence of a computer controller) and the pressure control could also be variably controlled without a computer or other electronic controller.

An endpoint detector 126 is also provided in the wafer carrier 100 according to a preferred embodiment of the invention. It is often difficult to accurately and repeatedly determine when each wafer being processed has been sufficiently polished to specifications. As a result, a "trial and error" approach is often relied upon, wherein the polishing process is stopped, and where the wafer may even be removed to examine whether the wafer has been sufficiently polished. If it has not, the polishing process must be continued. Even in cases where the wafer has not been removed, but has been inspected after halting the process, any of these "trial and error" techniques are time consuming and counterproductive.

The endpoint detector 126 measures a physical characteristic resultant from the moving interface between the wafer 102 and abrasive surface during polishing, to determine when the wafer surface has been polished to a sufficiently smooth and planar condition. The vibration caused by the moving interface between the wafer 102 and abrasive surface generates acoustical waves that can be measured and which change in frequency with the degree of surface roughness of the wafer 102. Thus, in one embodiment, endpoint detector 126 comprises a microphone which has a frequency response having a range which includes the frequencies of acoustical waves that are formed by an unfinished wafer and a sufficiently polished (i.e., finished) wafer. The microphone converts the acoustical waves to electrical signals which are inputted to a processor for comparison with a stored waveform that is characteristic of a finished wafer. When the frequency of the measured waveform reaches or exceeds the frequency of the stored waveform, the processor outputs a signal to stop the polishing process.

Alternatively or in addition to a microphone, wafer carrier 100 may be provided with an endpoint detector which comprises an accelerometer. A rough or nonplanar wafer, through interfacial moving contact with surface 112*a*, causes the surface 112*a* to vibrate or shutter up and down as the surface 112*a* moves across the nonplanar or rough surface of the wafer. The accelerometer measures the up and down movements of the surface 112*a*, and converts these measurements to electrical signals which are inputted to a processor for comparison with a stored waveform that is characteristic of a finished (i.e., sufficiently planar and smooth) wafer. When the frequency of the waveform made up of the electrical signals converted by the accelerometer meets or exceeds the frequency of the stored waveform, the processor outputs a signal to stop the polishing process.

Although endpoint sensor 126 is shown in FIG. 2 to be embedded in the platen 112, it may alternatively be mounted so as to contact the inner surface of the platen 112 within cavity 118. A connector 127 is preferably mounted in wafer carrier mount 110 for the electrical connection of noncontact displacement sensor 124, electronic circuitry 124*a* and endpoint detector 126 with a processor.

Wafer carrier 100 is further provided with a ring assembly which functions to retain wafer 102 in juxtaposition with platen surface 112*a* during polishing, said assembly comprising rings 128, 146 and 148. The vertical position of the ring assembly with respect to platen surface 112*a* can be accurately controlled and varied as the need arises. Additionally, the pressure applied by ring 146 against the abrasive surface during polishing may be accurately controlled, and acts to minimize any standing waves of chemical slurry (or of the abrasive pad) that tend to be generated by the motion of the head during polishing.

Figure 5:
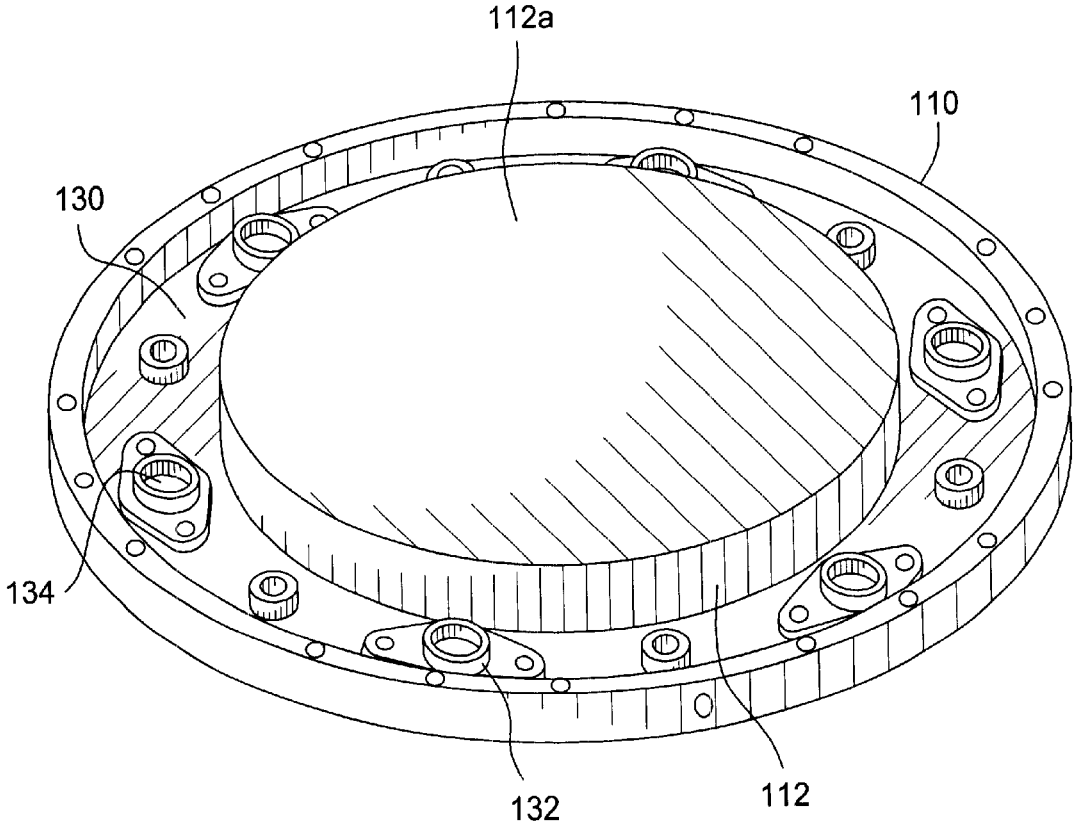
FIG. 5 is a perspective view of the under surface of a wafer carrier mount according to the present invention, with a platen mounted thereon.

Wafer carrier mount 110 is provided with an annular channel on the bottom side thereof. (see also FIG. 5*a*). Cavities 130*a* are formed in the channel 130 and are preferably equidistantly circumferentially placed. In a preferred embodiment, six cavities 130*a* are formed in the channel 130, but more or fewer cavities may be used. Equidistant circumferential placement of the cavities is preferred, since the cavities define the locations from which pressure is exerted against ring 128, and it is desirable to have the ability to apply a substantially constant force around the circumference of ring 128.

A diaphragm 132 is mounted in each of cavities 130a, and a cylinder ring 134 is fixed to the bottom side of head mount 110 (preferably by screws or bolts or other equivalent fixation elements) to seal each diaphragm 132 in an airtight manner between each respective cylinder ring 134 and the wafer carrier mount 110. Thus, a sealed cavity is formed between each diaphragm 132 and cavity 130*a*. On the top side of wafer carrier mount 110, opposite each cavity 130*a* location, a port 136*a* is formed. A pressure fitting 136 is fixed within each port 136*a*, preferably by mating threads. However, other equivalent methods of fixation may be employed. Also, various known types of thread sealant may be applied between the mating threads of the pressure fitting 136 and port 136*a* to improve the seal therebetween.

Pressure fittings 136 are connectable to tubing (not shown) for application of pressure/vacuum to control the pressure within the cavities 130*a*. Increase of pressure within cavities 130*a* causes a distention of diaphragms 132. Pistons 138 are abutted against diaphragms 132 in cavities 130*a*. Ring 128 is mounted to pistons 138, preferably by screws 140 although alternative, equivalent fixation elements may be employed. Screws 140 are countersunk with respect to the surface of ring 128 so as not to protrude beyond the under surface of ring 128.

Flexure ring 142 is mounted to wafer carrier mount 110 via screws 144 or other equivalent fixation elements, and is also mounted between ring 128 and pistons 138 via screws 140. Flexure ring 142 is preferably made of spring steel or another metal having similar stiff yet resilient properties. Flexure ring 142 functions to connect ring 128 to wafer carrier mount 110, while allowing some vertical movement of ring 128 with respect to wafer carrier mount 110. Thus, when pressure is applied to cavities 130*a*, diaphragms 132 distend to move pistons 138, and hence, ring 128, in a vertical direction away from wafer carrier mount 110. At the same time, flexure ring 142 has enough flexibility to flex and allow movement of ring 128 with respect to wafer carrier mount 110. Upon release of the pressure within cavities 130*a*, potential energy stored in the flexure element is converted to kinetic energy and acts to retract ring 128 and pistons 138 in a vertical direction toward wafer carrier mount 110.

To the bottom surface of ring 128 are mounted a retainer 146 and clamp ring 148, preferably by screws 150 or other equivalent attachment elements. Retainer 146 is preferably made of a polyacetyl copolymer such as DELRIN (or other substantially equivalent linear acetyl resin, or polyphenko ertalyte. Clamp ring 148 is preferably made of stainless steel or other metal suitable for use in the production of the wafer carrier according to the present invention as described above. Clamp ring 148 is sufficiently rigid to ensure an immovable fixation of the retainer 146 with ring 128. Retainer 146 is designed to be durable and tough, but is expected to wear during operation. Retainer 146 is substantially electrically nonconductive to avoid any potential interference with the semiconductive properties of the wafer (e.g., wear of a metal retainer could introduce metal particles into the wafer). Retainer 146 may be readily replaced after sufficient wear has occurred.

Retainer 146 is controlled, through the arrangement described above, so as to extend vertically below the lower surface 112*a* of wafer plate 112. Retainer 146 functions to maintain wafer 102 in ajuxtaposed relationship (i.e, prevents "wafer slip-out") with surface 112*a* and also in contact with surface 112*a*. Further, the downward pressure applied by retainer 146 provides a smoothing action to standing waves that tend to develop in the abrasive pad and/or slurry. Still further, retainer 146 acts to alleviate forces that tend to enhance edge exclusion of the wafer during polishing.

Figure 2A:
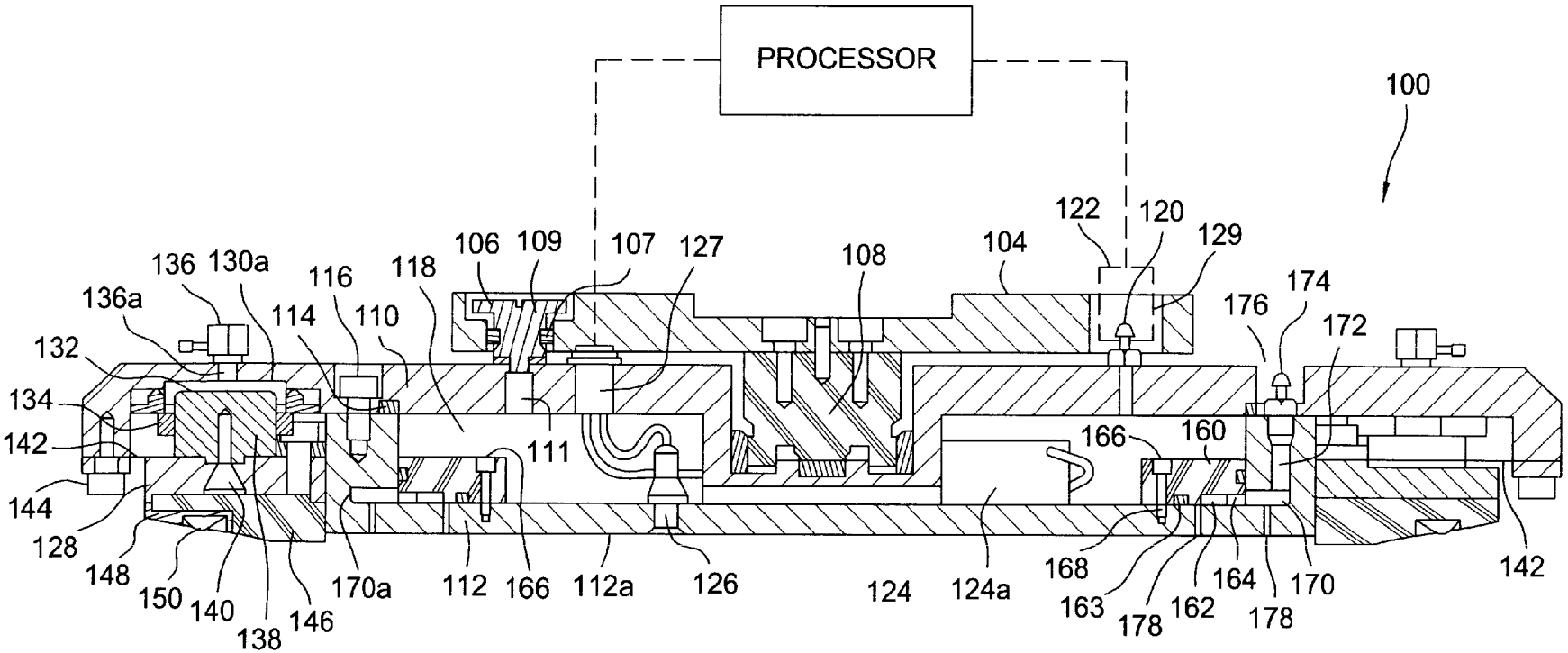
FIG. 2*a* is a sectional view of a wafer carrier for a CMP apparatus according to the present invention.
Figure 2B:
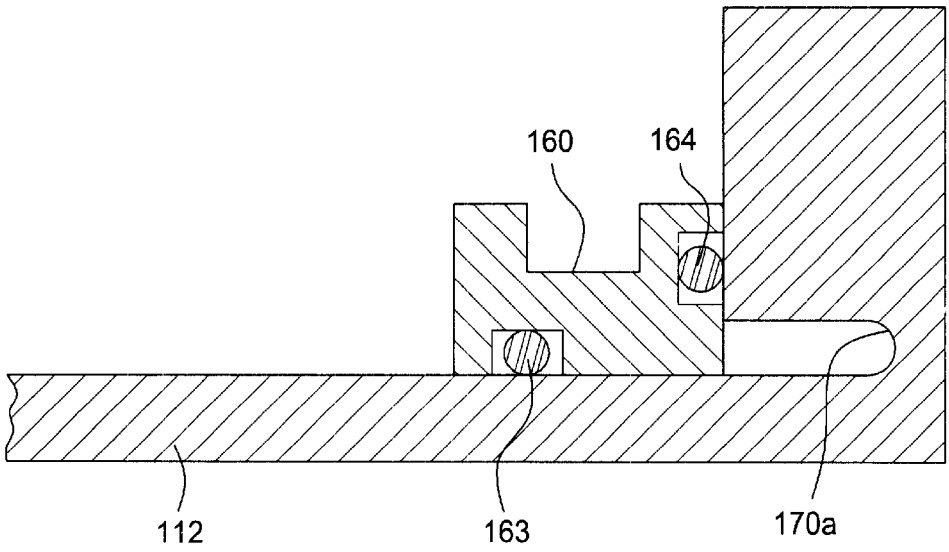
FIG. 2*b* is a partial, cross-sectional view showing details of a wafer plate and manifold according to the present invention.
Figure 6:
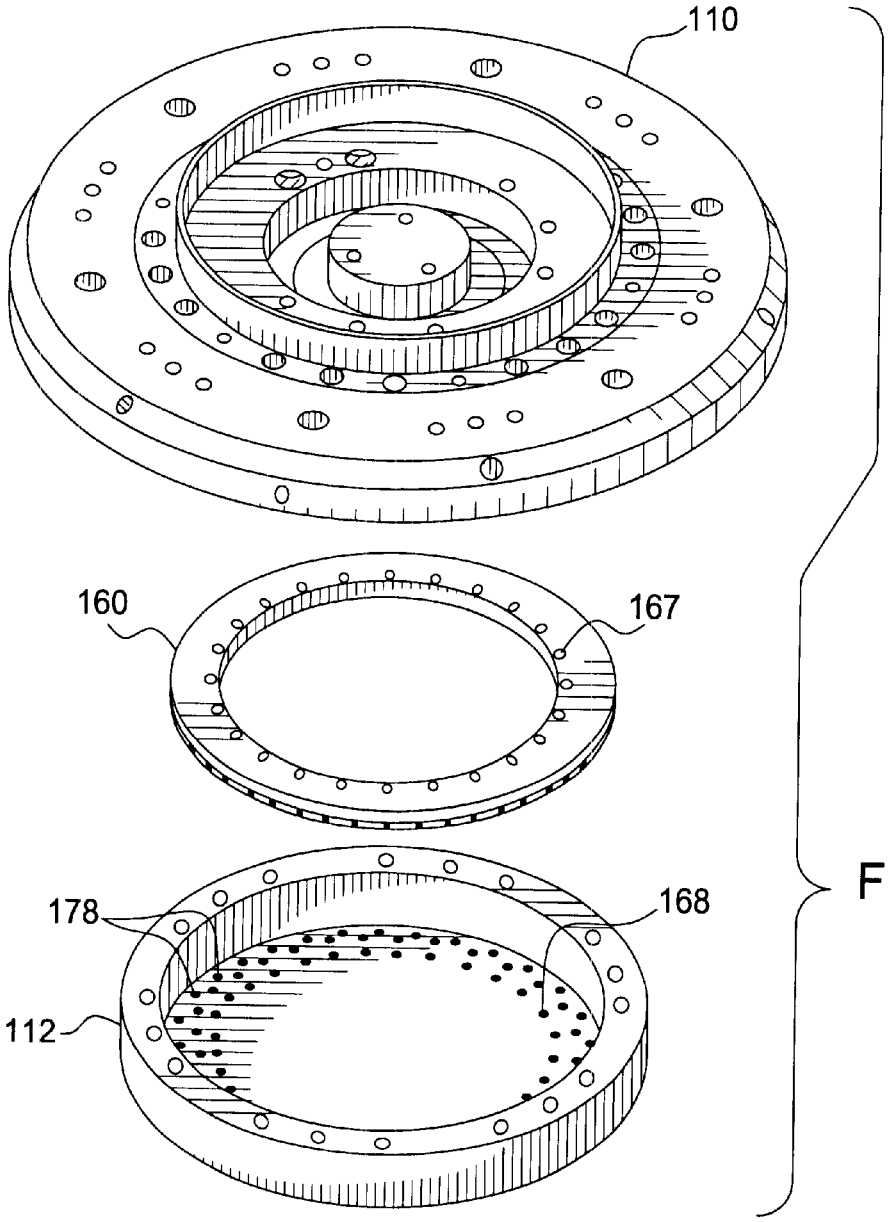
FIG. 6 is an exploded view of a wafer carrier mount, manifold and platen according to the present invention.
Figure 7:
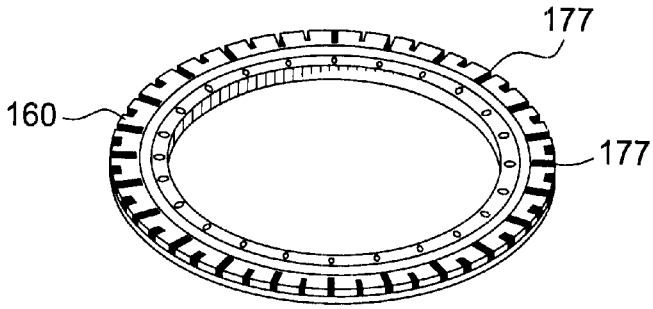
FIG. 7 is a view of the under surface of the manifold shown in FIG. 6.

Wafer carrier 100 is further provided with a manifold 160 which establishes a cavity 162 that is capable of maintaining a pressure which is independent of the pressure of cavity 118. Manifold 160 is an annular, rigid or semi-rigid element that is installed against the inner walls of wafer plate 112 as shown in FIGS. 2*a*, 2*b* and 6. Manifold 160 is preferably made of DELRIN (an acetyl-copolymer), but alternative materials may be used to make the same, e.g., KYNAR (poly vinyl-idene fluoride). The interfaces between manifold 160 and the walls of wafer plate 112 are made air/pressure tight by the provision of O-rings 163,164, or other sealing elements which are known to be equivalent in the art. In the embodiment shown in FIGS. 2*a* and 6, manifold 160 is held in position using screws 166. Holes 167 are provided through manifold 160 which allow the shafts of screws 166 to pass therethrough. Blind holes 168 are drilled partially through the thickness of wafer plate 112, and are then tapped to allow screws 166 to be threaded thereinto. Wafer plate 112 includes an annular channel 170 formed where the vertical walls of wafer plate 112 meet the horizontal wall of wafer plate 112. Wafer plate 112 further includes at least one hole 172 which passes through the vertical wall and joins channel 170. In a preferred embodiment, wafer plate 112 has six holes 172, but more may be employed and as few as one hole will still render the design functional. Each hole 172 is preferably threaded at the top to allow a pressure fitting 174 to be threaded therein in a pressure/air tight fashion. Alternative methods of fixing the pressure fitting(s) may be employed, such as press fitting, welding, etc. Wafer carrier mount 110 includes an opening 176 above each pressure fitting 174 to allow easy access thereto for connection with a pressure hose 180 (see FIG. 3). Pressure fitting(s) 174 are interconnected to a pressure/vacuum source via the above-mentioned pressure hose so that the pressure in cavity 162 can be controlled and varied or maintained according to need. Preferably, the pressure/vacuum source is controlled by an electronic processor, but control may also be manually performed. Thus, even if only one pressure fitting 174 is provided, pressure/vacuum which is introduced therethrough is substantially equally distributed circumferentially all the way around cavity 162 via annular channel 170 and manifold inlets 177 (see FIG. 7). The inputted pressure/vacuum is transferred or conducted through holes 178 which pass through the horizontal wall of wafer plate 112, so that the intended effect is produced at the surface 112*a* of wafer plate 112.

Accordingly, cavity 162 can be pressure controlled to effect the wafer through holes 178. For example, at the completion of polishing, a vacuum can be established in cavity 162 so as to apply suction to the wafer 102 through holes 178. Thus, when the wafer carrier 100 is lifted from the abrasive surface, the wafer 102 is lifted with it, since it is held to surface 112*a* by vacuum. To release wafer 102, the pressure in cavity 162 is then raised to a positive pressure exhausting through holes 178. Positive pressure can also be used as a purge, to clear any obstruction of the holes 178 that may have occurred.

Annular channel 170 and cavity 162 greatly enhance the ability of the wafer carrier to apply vacuum/pressure to wafer 102. Previously, pressure fittings have been mounted directly into the platen such that each hole for passing air (either vacuum or pressure) onto the platen surface was connected via a dedicated pressure fitting and pressure line. Because each pressure fitting had to be threaded or otherwise securely connected within the horizontal platen wall, the number of holes to be used to apply vacuum/pressure to the wafer was severely limited. It was difficult to install more than six vacuum/pressure holes in a platen, and the installation of more would begin to substantially effect the diaphragm action of the platen wall.

With the present arrangement, a large number of holes 178 is preferred and can be effected, since the holes 178 are simply made to perforate the horizontal platen wall and do not require a pressure fitting to be threaded therein. Rather, as described above, substantially equal pressures are supplied to each hole 178 via channel 170 and cavity 162. The result is an ability to draw a much stronger and more effective suction force against the wafer 102 in order to pick it up with the wafer carrier 100. Blow-off and purge pressures are likewise greatly improved. This arrangement can also mechanically transfer the pressure force from cavity 118 to the horizontal wafer plate wall while minimizing alteration of the effects on the static shape of surface 112*a* and flexural characteristics.

Thus, channel 170 and cavity 162 form a pressure controllable cavity within cavity 118, which is completely independent of the pressure within cavity 118. For example, a positive pressure can be applied in cavity 118 to distend surface 112*a* at the same time that a vacuum is maintained within channel 170 and cavity 162 to attract and hold wafer 102 in contact with surface 112*a*.

In addition to distributing fluid flow, as can be seen in the detailed view in FIG. 2*b*, annular channel 170 includes a "living hinge" or notch 170*a* which functions to allow surface 112*a* to minimize geometric distortions at the periphery and allow surface 112*a* to closely assume a substantially spherical shape. Living hinge 170*a* is formed circumferentially about the platen, where the vertical wall of the platen meets the horizontal wall of the platen that includes surface 112*a*. By allowing additional flexure at the junction between the walls, living hinge 170*a* prevents distortions which would otherwise occur in the outer periphery of the surface 112*a* upon flexure or crowning of the surface 112*a*, if no such living hinge were present.

Figure 3:
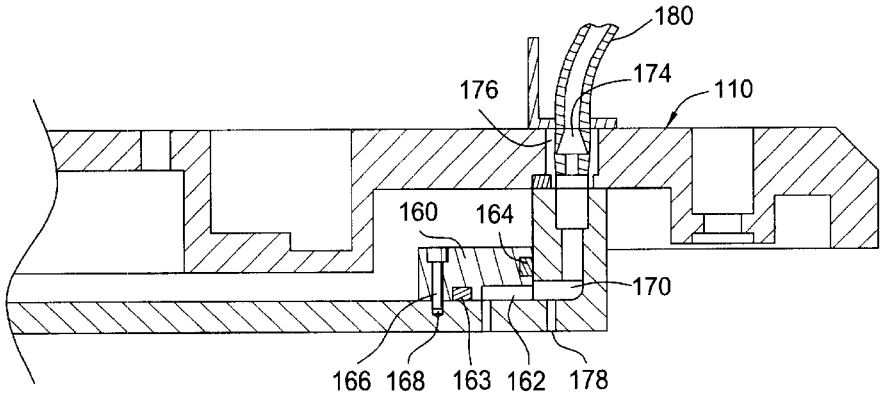
FIG. 3 is an enlarged partial view of the wafer carrier shown in FIG. 2*a*, which exemplifies one embodiment of a wafer pickup feature of the wafer carrier according to the present invention.
Figure 4:
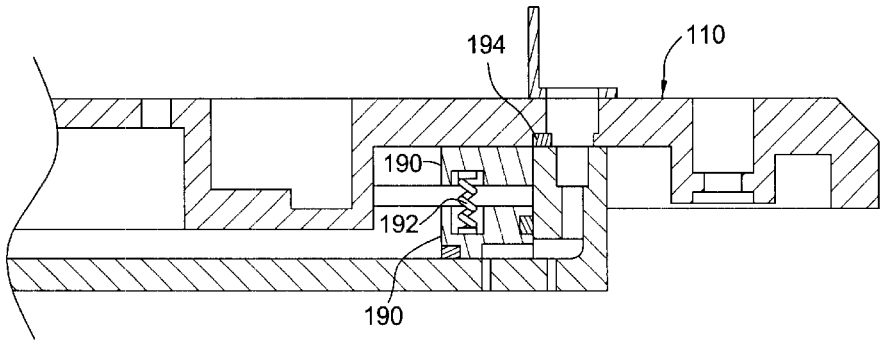
FIG. 4 is an enlarged partial view of the wafer carrier shown in FIG. 2*a*, which exemplifies another embodiment of a wafer pickup feature of the wafer carrier according to the present invention.

FIG. 3 shows a partial cross section of a head using a manifold 160 which is screwed to wafer plate 112 via screws 166 as described above with regard to FIGS. 2 and 6. In this embodiment, manifold 160 does not apply any additional force to the horizontal wall of wafer plate 112. However, blind fastener penetrations (blind holes) 168 must be formed in the horizontal wall of wafer plate 112, and threaded to allow affixation of screws 166. An alternate embodiment uses a manifold 190 that does not require affixation with screws, as shown in FIG. 4.

Manifold 190 is a two piece annular manifold that includes springs 192 between the two pieces. Springs 192 are preloaded to exert equal and opposite forces on the two pieces of manifold 190 so as to position the two pieces in contact with the horizontal wall of wafer plate 112 and the lower surface of wafer carrier mount 110, respectively.

The spring loaded manifold provides for simpler manufacturing of the wafer carrier, since blind holes 168 need not be provided in wafer plate 112. On the other hand, springs 192 apply an additional force to the horizontal wall of wafer plate 112.

What is claimed is:

1. A wafer carrier comprising:

a substantially inflexible wafer carrier mount;

a platen having a flexible member defined between walls, said walls of said platen being mounted to said wafer carrier mount so that said wafer carrier mount and said platen form a first cavity therebetween; and a second cavity defined within said first cavity;

wherein a pressure inside said second cavity can be controlled independently of a pressure inside said first cavity.

2. The wafer carrier of claim 1, further comprising:

at least one hole through said wafer carrier mount connecting with said first cavity, wherein said first cavity may be alternately pressurized or evacuated via said at least one hole to deform said flexible member away from or toward said first cavity.

3. The wafer carrier of claim 1, further comprising:

a non-contact displacement sensor adapted to measure a distance between said wafer carrier mount and said flexible member.

4. The wafer carrier of claim 3, further comprising:

an electrical connector mounted in said wafer carrier mount and electrically connected to said non-contact displacement sensor, wherein said non-contact displacement sensor converts said distance, after measuring, to an electrical signal and said electrical signal is outputted from said wafer carrier via said connector.

5. The wafer carrier of claim 1, further comprising:

an endpoint detector adapted to detect a relative surface roughness of a wafer to determine when the wafer has been sufficiently polished.

6. The wafer carrier of claim 1, further comprising:

a ring peripherally located about an outer edge of said platen, said ring mounted and positioned to resist lateral forces on a wafer, in contact with said platen, caused by engagement of a face of the wafer with a polishing surface.

7. The wafer carrier of claim 6, further comprising:

an adjustable coupling mounted between said ring and said wafer carrier mount to allow adjustable positioning of a height of said ring with respect to said wafer carrier mount and said platen.

8. The wafer carrier of claim 7, wherein said adjustable coupling comprises a flexure ring which flexes during lowering of the height of said ring, and wherein said flexure ring stores potential energy during said lowering, said potential energy being converted to kinetic energy upon raising the height of said ring so as to at least assist in said raising of said ring.

9. The wafer carrier of claim 6, further comprising:

a retainer mounted to a lower surface of said ring, said retainer adapted to contact the wafer and the polishing surface during polishing.

10. A wafer carrier comprising:

a substantially inflexible wafer carrier mount;

a platen having a flexible member defined between walls, said walls of said platen being mounted to said wafer carrier mount so that said wafer carrier mount and said platen form a first cavity therebetween;

a second cavity defined within said first cavity;

wherein a pressure inside said second cavity can be controlled independently of a pressure inside said first cavity; and wherein said second cavity is defined by a manifold sealably mounted to inner surfaces of said flexible member and said walls.

11. The wafer of claim 10, wherein said manifold is mounted to said flexible member.

12. The wafer carrier of claim 10, said manifold comprising:

an upper portion;

a lower portion; and at least one spring member provided between said upper portion and said lower portion, said at least one spring member preloaded so as to apply forces against said upper and lower members to maintain said upper and lower members in sealing contact against said wafer carrier mount and said flexible member, respectively.

13. The wafer carrier of claim 10, further comprising:

at least one seal between said manifold and said flexible member; and at least one seal between said manifold and said walls.

14. A wafer carrier comprising:

a substantially inflexible wafer carrier mount;

a platen having a flexible member defined between walls, said walls of said platen being mounted to said wafer carrier mount so that said wafer carrier mount and said platen form a first cavity therebetween;

a second cavity defined within said first cavity;

wherein a pressure inside said second cavity can be controlled independently of a pressure inside said first cavity;

a channel formed between said flexible member and said walls, said channel joining said second cavity; and at least one hole traversing said wafer carrier mount and one of said walls and connecting with said channel.

15. A wafer carrier comprising:

a substantially inflexible wafer carrier mount;

a platen having a flexible member defined between walls, said walls of said platen being mounted to said wafer carrier mount so that said wafer carrier mount and said platen form a first cavity therebetween;

a second cavity defined within said first cavity;

wherein a pressure inside said second cavity can be controlled independently of a pressure inside said first cavity; and at least two holes through said flexible member and connecting with said second cavity;

wherein said pressure in said second cavity is distributed substantially equally to each of said at least two holes.

16. The wafer carrier of claim 15, wherein said at least two holes comprise a plurality of holes extending around at least a perimeter of said flexible member.

17. A wafer carrier comprising:

a substantially inflexible wafer carrier mount;

a platen having a flexible member defined between walls, said walls of said platen being mounted to said wafer carrier mount so that said wafer carrier mount and said platen form a first cavity therebetween;

a second cavity defined within said first cavity;

wherein a pressure inside said second cavity can be controlled independently of a pressure inside said first cavity;

an endpoint detector capable of detecting a relative surface roughness of a wafer to determine when the wafer has been sufficiently polished; and an electrical connector mounted in said wafer carrier mount and electrically connected to said endpoint detector, wherein said endpoint detector measures a physical characteristic resultant from moving contact between the wafer and an abrasive surface during polishing, and converts said physical characteristic, after measuring, to an electrical signal, and said electrical signal is outputted from said wafer carrier via said connector.

18. A wafer carrier comprising:

a substantially inflexible wafer carrier mount;

a platen having a flexible member defined between walls, said walls of said platen being mounted to said wafer carrier mount so that said wafer carrier mount and said platen form a first cavity therebetween;

a second cavity defined within said first cavity;

wherein a pressure inside said second cavity can be controlled independently of a pressure inside said first cavity;

a ring peripherally located about an outer edge of said platen, said ring mounted and positioned to resist lateral forces on a wafer, in contact with said platen, caused by engagement of a face of the wafer with a polishing surface;

a plurality of wafer carrier mount cavities circumferentially located about an underside of said wafer carrier mount;

a plurality of wafer carrier mount holes connecting said plurality of wafer carrier mount cavities with a top side of said wafer carrier mount, respectively;

a diaphragm sealably mounted in each of said plurality of wafer carrier mount cavities; and a plurality of piston mounted to said ring, each of said plurality of pistons slidably fitted in each of said plurality of wafer carrier mount cavities, respectively;

wherein gas or fluid can be inputted through said plurality of wafer carrier mount holes to pressurize said wafer carrier mount cavities, thereby distending said diaphragms, said diaphragms pushing said pistons to lower said ring.

19. An apparatus for polishing a wafer comprising:

a table having an upper surface;

a polishing medium applied to said upper surface;

a wafer carrier mount support movably connected to said table;

a substantially inflexible wafer carrier mount connected to said wafer carrier mount support;

a platen having a flexible member defined between walls, said walls of said platen being mounted to said wafer carrier mount so that said wafer carrier mount and said platen form a first cavity therebetween; and a second cavity defined within said first cavity;

wherein a pressure inside said second cavity can be controlled independently of a pressure inside said first cavity.

* * * * *